US007325719B2

(12) United States Patent
Palm

(10) Patent No.: US 7,325,719 B2
(45) Date of Patent: Feb. 5, 2008

(54) GABLE-TOP PACKAGE FOR POURABLE FOOD PRODUCTS

(75) Inventor: Lars-Erik Palm, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 452 days.

(21) Appl. No.: 10/480,998

(22) PCT Filed: Jul. 11, 2002

(86) PCT No.: PCT/EP02/07747

§ 371 (c)(1),
(2), (4) Date: Dec. 17, 2003

(87) PCT Pub. No.: WO03/006327

PCT Pub. Date: Jan. 23, 2003

(65) Prior Publication Data

US 2004/0169066 A1 Sep. 2, 2004

(30) Foreign Application Priority Data

Jul. 12, 2001 (EP) ..... 01116987

(51) Int. Cl.
*B65D 5/08* (2006.01)
*B65D 5/74* (2006.01)
*B65B 7/20* (2006.01)

(52) U.S. Cl. ..... 229/125.42; 53/491; 53/565; 229/137

(58) Field of Classification Search ..... 229/125.42, 229/137, 213, 214, 249; 53/376.3, 376.4, 53/491, 565

See application file for complete search history.

(56) References Cited

U.S. PATENT DOCUMENTS

| | | | | | |
|---|---|---|---|---|---|
| 1,950,104 | A | | 3/1934 | Ewers | |
| 2,113,481 | A | * | 4/1938 | Kasdorf | 229/125.42 |
| 2,321,139 | A | | 6/1943 | Gruger | |
| 2,333,123 | A | * | 11/1943 | Ringler | 229/214 |
| 3,040,951 | A | * | 6/1962 | Kuchenbecker | 229/214 |
| 3,743,165 | A | | 7/1973 | Hopkins | |
| 4,450,581 | A | * | 5/1984 | Hirata | 229/214 |
| 4,787,507 | A | * | 11/1988 | Rausing | 229/214 |
| 5,029,751 | A | * | 7/1991 | Detzel | 229/125.42 |
| 5,601,233 | A | * | 2/1997 | Kageyama et al. | 229/125.42 |
| 5,871,144 | A | * | 2/1999 | Anchor et al. | 229/109 |
| 6,027,016 | A | | 2/2000 | Ljungstrom et al. | |

FOREIGN PATENT DOCUMENTS

| | | | | |
|---|---|---|---|---|
| DE | 10 60 702 | | 7/1959 | |
| EP | 0438735 | | 7/1991 | |
| FR | 2048352 | | 3/1971 | |
| JP | 50 141474 | | 11/1975 | |
| JP | 3-212340 | A * | 9/1991 | 229/214 |
| WO | 02 10020 | | 2/2002 | |

* cited by examiner

*Primary Examiner*—Gary E Elkins
(74) *Attorney, Agent, or Firm*—Buchanan, Ingersoll & Rooney PC

(57) ABSTRACT

A gable top package for pourable food products comprising a gabled top portion including a front sloping top wall and a back sloping top wall joined together at a top transversal seal, wherein the gabled top portion includes a pair of lateral flaps adjacent to respective end portions of the top transversal seal and folded out of the package top volume available for the food product and delimited by the front and back sloping top walls.

16 Claims, 5 Drawing Sheets

GABLE-TOP PACKAGE FOR POURABLE FOOD PRODUCTS

TECHNICAL FIELD

The present invention relates to a gable-top package for pourable food products.

BACKGROUND ART

As is known, many pourable food products, such as fruit juice, UHT (ultra-high-temperature processed) milk, wine, tomato sauce, etc., are sold in packages made of sterilized packaging material.

The packaging material has a multilayer structure comprising a layer of fibrous material, e.g. paper, covered on both sides with layers of heat-seal plastic material, e.g. polyethylene, and, in the case of aseptic packages for long-storage products, such as UHT milk, also comprises a layer of oxygen-barrier material defined, for example, by an aluminium film, which is superimposed on a layer of heat-seal plastic material and is in turn covered with another layer of heat-seal plastic material eventually defining the inner face of the package contacting the food product.

A typical example of such a package is the parallelepiped-shaped package for liquid or pourable food products known as Tetra Brik Aseptic (registered trademark), which is formed from a continuous tube obtained by bending and longitudinally sealing a web packaging material; the web of packaging material is sterilized on the packaging machine itself, e.g. by applying a chemical sterilizing agent, such as a hydrogen peroxide solution, which, after sterilization, is removed, e.g. vaporized by heating, from the surfaces of 10 the packaging material; and the web of packaging material so sterilized is maintained in a closed sterile environment, and is folded and sealed longitudinally to form a vertical tube.

The tube is filled with the sterilized or sterile-processed food product, and is sealed and cut at equally spaced cross sections to form pillow packs, which are then folded mechanically to form the finished, e.g. substantially parallelepiped-shaped, packages.

Two basic types of web-fed filling and forming machines are known: a first and more common type is a machine having two pairs of reciprocating jaws; this type of machines includes, e.g the TB and TBA series produced by Tetra Brick Packaging Systems at LUND (Sweden), Ruben Rausings gata and at Modena (Italy), Via Delfini 1. The second type of web-fed packaging machine is the endless chain type, wherein forming and sealing units are carried by two facing endless chains rather then by reciprocating jaws.

To allow folding of the web packaging material both during forming and final folding., crease lines defining a so-called "crease pattern" are formed on the packaging material at the production line.

Alternatively, the packaging material may be cut into blanks, which are formed into packages on forming mandrel, and the resulting packages are filled with the food product and sealed. One example of such a package is the so-called "gable-top" package commonly known by the trade name Tetra Rex (registered trademark), which has a gabled top portion defined by two inclined or sloping walls joined together at a top transversal seal.

In particular, once formed on the forming mandrels, the unfinished packages have an upwardly opened parallelepiped shape; the gabled top portion is obtained by compressing opposite side walls of the upper portion of the unfinished packages towards each other in order to draw up the upper edges of the other walls, which are then sealed together to form the transversal seal.

Once formed, packages of the above type may undergo further processing steps, such as the application of a re-closable opening device.

Gable-top packages are very conveniently used in combination with re-closable opening devices because the sloping top walls are wider than corresponding flat portions of parallelepiped and therefore allow the application of larger opening devices, e.g. provided with screw caps or the like.

DISCLOSURE OF THE INVENTION

A scope of the present invention is to provide a gable-top type package, which can be easily and cheaply produced by web fed filling machines such as the above-mentioned TB and TBA series or the endless chain type, without substantial modifications of such machines.

Another scope of the present invention is to provide a method for obtaining such a gable-top package.

A further scope of the present invention is to devise a web packaging material provided with a crease pattern that is adapted to obtain such a gable-top package.

BRIEF DESCRIPTION OF THE DRAWINGS

Three preferred, non-limiting embodiments of the present invention will be described by way of example with reference to the accompanying drawings, in which.

BEST MODE FOR CARRYING OUT THE INVENTION

Figure 1:
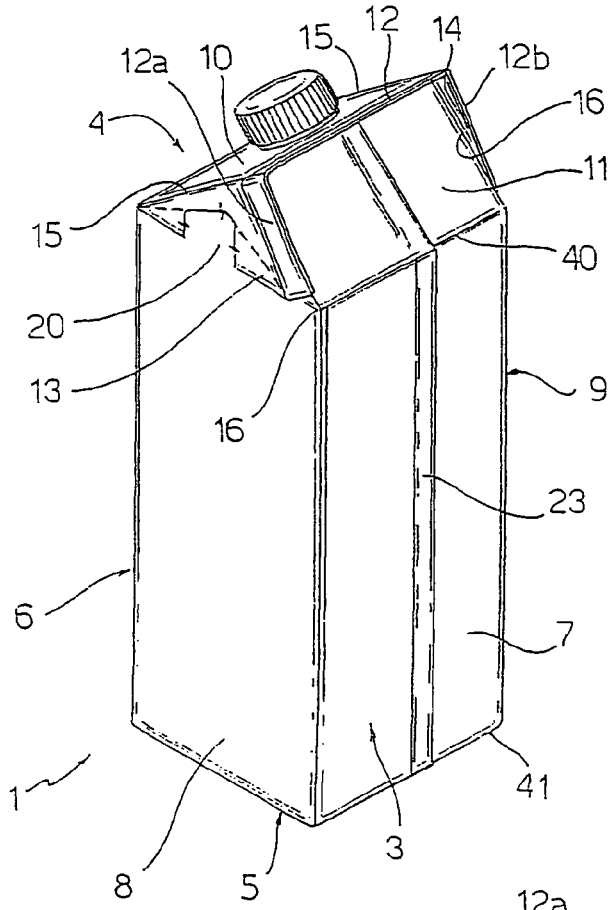
FIG. 1 is a perspective view of a gable-top package according to the present invention.
Figure 3:
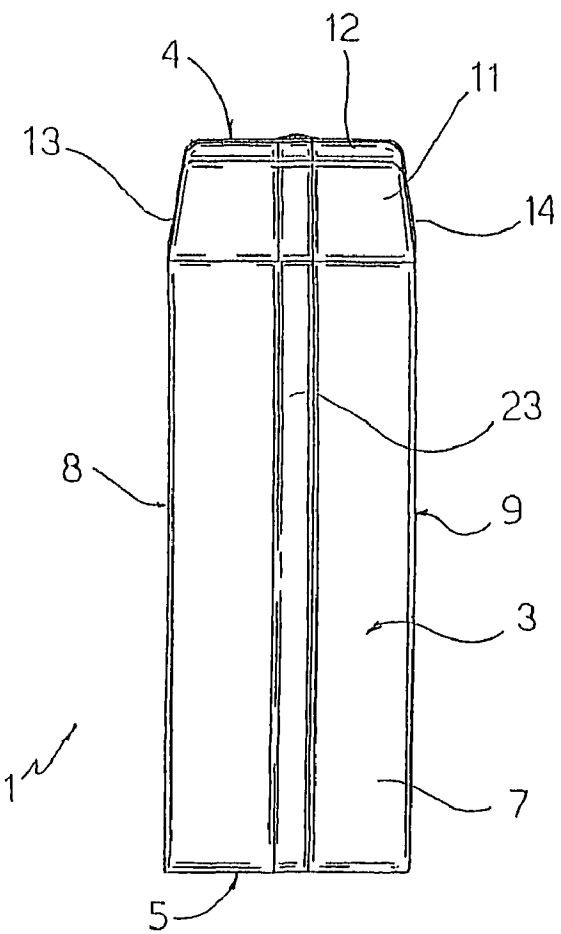
FIG. 3 is a back elevational view of the package of FIG. 1.
Figure 2:
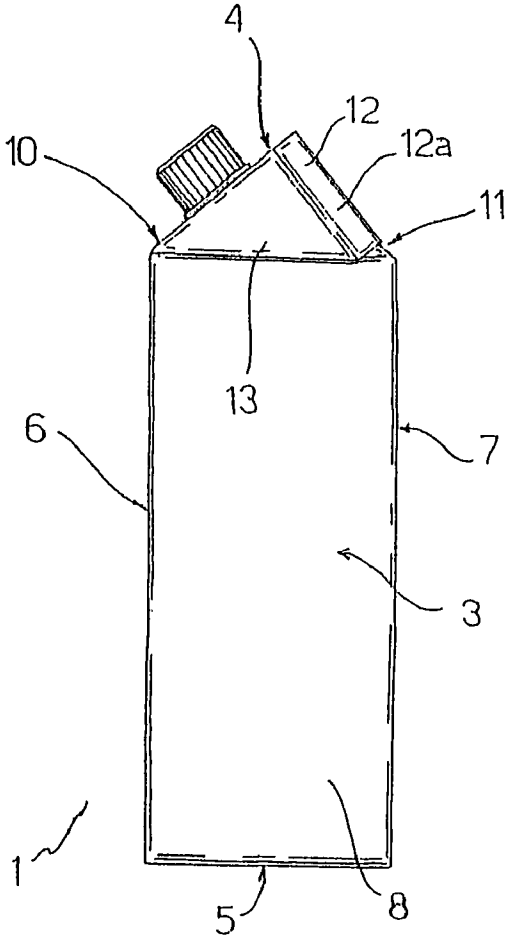
FIG. 2 is a side elevational view of the package of FIG. 1.

With reference to FIGS. 1, 2 and 3, numeral 1 references a gable-top package for food products according to the present invention.

Package 1 is made from a web packaging material 2 (FIG. 5)—hereinafter "material 2"—and essentially comprises a parallelepiped-shaped main portion 3 and a gabled top portion 4 upwardly delimiting main portion 3.

In particular, main portion 3 has a preferably square-shaped base wall 5, a front wall 6, a back wall 7, and a pair of side walls 8, 9.

Gabled top portion 4 includes a front sloping top wall 10 and a back sloping top wall 11 which join together at a top transversal seal 12 of the package 1.

According to an important aspect of the present invention, gabled top portion 4 includes a pair of top lateral flaps 13, 14 adjacent to respective lateral end portions 12*a*, 12*b* of top transversal seal 12 and folded out of the package top volume available for the food product and delimited by front and back sloping top walls 10, 11.

Each lateral flap 13, 14 has one side defined by a lateral edge 15 of front sloping top wall 10 and another side formed by a relative lateral end portion 12*a*, 12*b* of transversal seal 12 and folded onto a lateral edge 16 of back sloping top wall 11.

Lateral flaps 13, 14 are folded onto respective triangular top portions 20 of side walls 8, 9. Top portions 20 are flat, and substantially coplanar or gently inwardly sloped with respect to respective side walls 8, 9 as better explained hereafter.

Figure 4:
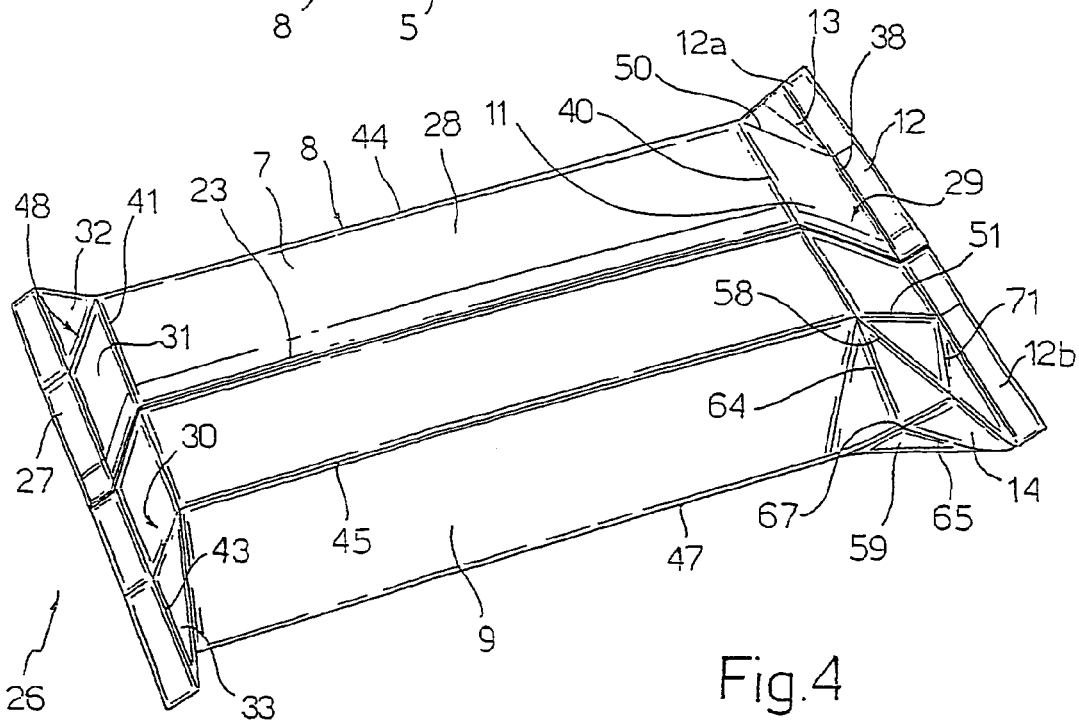
FIG. 4 is a perspective view of a pillow-pack constituting an intermediate product for the production of the package of FIG. 1.
Figure 5:
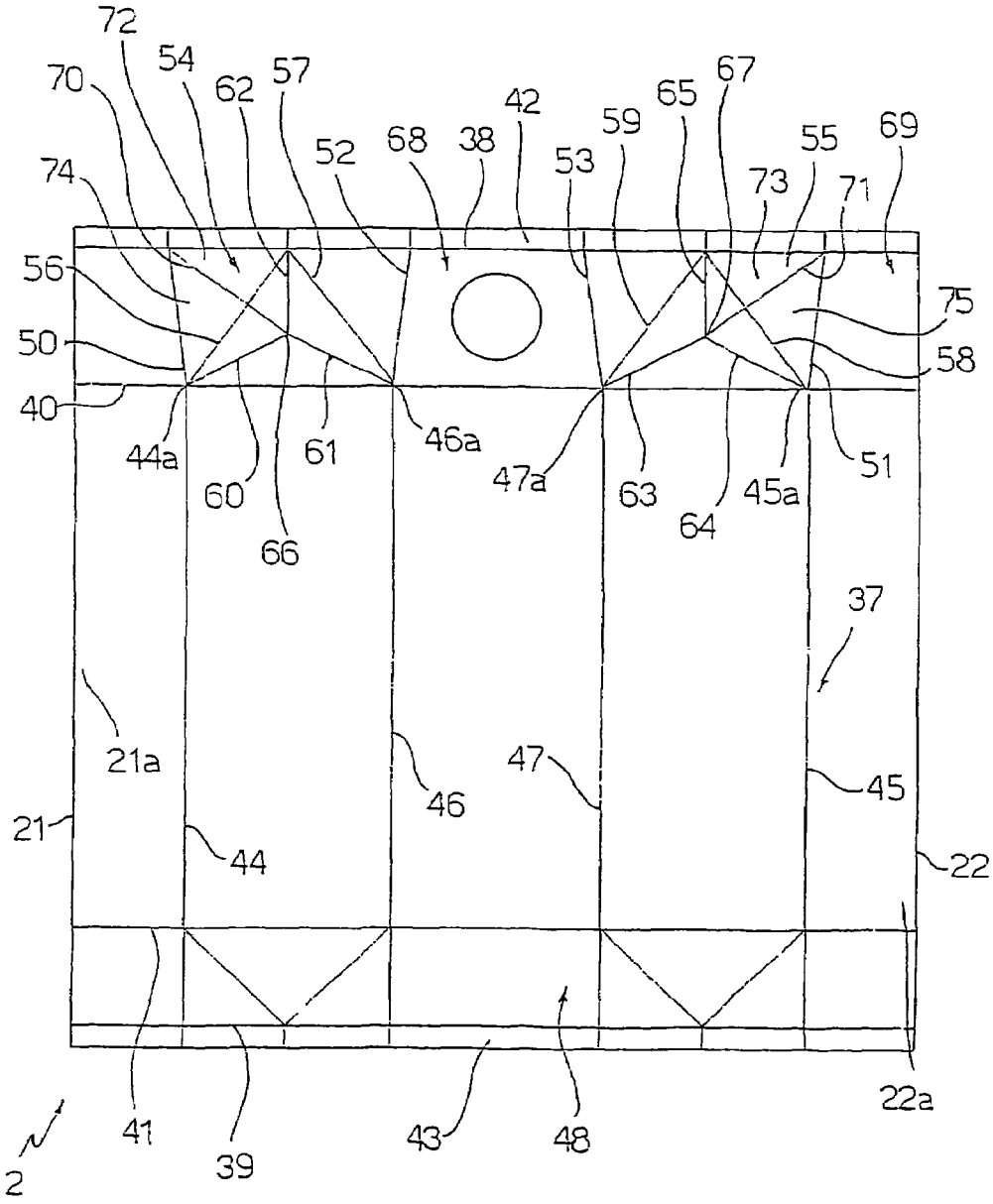
FIG. 5 is a repeatlength portion of a web packaging material for the production of the package of FIG. 1.

For a better comprehension of the new package shape, reference is now made to FIGS. 4 and 5.

Package 1 is made from a continuous tube (not shown) of packaging material, which is obtained by bending and longitudinally sealing material 2. (FIG. 5) along lateral edges 21, 22 thereof. More precisely, an edge portion 21*a* of material 2 is superimposed and sealed onto the opposite edge portion 22*a* so as to obtain a longitudinal seal 23 which extends substantially along a vertical centreline of back wall 7 of the finished package 1.

The tube is then transversally sealed at regular intervals to form transversal seals and then cut along such transversal seals to form so-called pillow packs, which are intermediate products adapted to be transformed into finished packages 1 by means of a plurality of final folding step. A pillow pack, referenced 26, is shown in FIG. 4.

Referring to a single finished package 1, or in equivalent manner to a single pillow pack 26, said transversal seals include the above mentioned top transversal seal 12 and a bottom transversal seal 27, shown in FIG. 4.

Pillow pack 26 comprises a parallelepiped basic portion 28 delimited by four walls corresponding to walls 6, 7, 8, 9 of main portion 3 of finished package 1, and opposite tapered end portions 29, 30 tapering from basic portion 28 to respective transversal seals 12, 27.

Tapered end portion 29 defines front and back sloping top walls 10, 11 of finished package 1 and is provided with lateral flaps 13, 14 protruding from opposite sides of front and back sloping top walls 10, 11 and, as above explained, adapted to be folded onto respective top portions 20 of side walls 8, 9.

Tapered end portion 30 is adapted to be folded in a known manner to obtain base wall 5; in particular, tapered end portion 30 is formed by a pair of sloping walls 31 joined together at bottom transversal seal 27 and defining a pair of protruding bottom lateral flaps 32, 33.

To flatten base wall 5, tapered end portion 30 is compressed towards tapered end portion 29, so as to fold and seal lateral flaps 32, 33 onto sloping walls 31.

Web material 2 includes a crease pattern 37, i.e. a plurality of weakened lines obtained by creasing rolls and forming folding lines along which the material is folded during the forming and final folding steps.

FIG. 5 shows a repeatlength of material 2, i.e. the exact length of material which is used to produce a single package 1.

Crease pattern 37 includes, in a known manner, four transversal crease lines 38, 39, 40, 41: lines 38, 39 are near the transversal ends of the repeatlegth and delimit respective top and bottom transversal sealing areas 42, 43; lines 40, 41 form the horizontal corners of gabled top portion 4 and of base wall 5, and are indicated in FIGS. 1 and 4, for the sake of clarity.

Crease pattern 37 also includes, in a known manner, four longitudinal crease lines 44, 45, 46, 47 forming the side corners of package 1 and extending between transversal crease lines 40, 41, as well as a plurality of crease lines 48 in the area comprised between line 41 and bottom transversal sealing area 43, which are designed so as to produce bottom lateral flaps 32, 33 (FIG. 4) of pillow pack 26. Lines 48 have a known arrangement and are not described in detail.

Longitudinal crease lines 44, 45 are near respective lateral edges 21, 22, whilst longitudinal crease lines 46, 47 are interposed between lines 44, 45.

For sake of clarity, front wall 6 of package 1 is delimited by lines 46, 47, back wall 7 is delimited by lines 44, 45, side wall 8 is delimited by lines 44, 46 and side wall 9 is delimited by lines 45, 47.

Crease pattern 37 further includes a plurality of additional crease lines in the area comprised between transversal crease line 40 and top sealing transversal sealing area 42. Such additional crease lines include four substantially longitudinal crease lines 50, 51, 52, 53 defining the lateral corners of front sloping top wall 10 and back sloping top wall 11 and originating at intersection points, 44*a*, 45*a*, 46*a*, 47*a* of line 40 with each of longitudinal lines 44, 45, 46, 47. In the shown examples, lines 50, 51, 52 and 53 are slightly inclined so as to form walls 10, 11 of trapezoidal shape tapering upwards, but could be perfectly longitudinal, i.e. constitute prolongations of longitudinal lines 44, 45, 46, 47.

Lines 50, 52, the portion of top transversal seal area 42 comprised between lines 50, 52 and the portion of line 40 comprised between intersection points 44*a*, 46*a* delimit a flap zone 54 defining lateral flap 13. Analogously, lines 51, 53, the portion of top transversal seal area 42 comprised between lines 51, 53 and the portion of line 40 comprised between intersection points 45*a*, 47*a* delimit a flap zone 55 defining lateral flap 14. Furthermore, longitudinal crease lines 50, 51, 52, 53, transversal crease line 40 and transversal sealing area 42 delimit other two zones 68, 69 each interposed between zones 54, 55 and defining respectively front and back sloping top walls 10, 11.

Crease pattern 37 further includes, in each flap zone 54, 55, a couple of inclined crease lines 56, 57 and, respectively 58, 59, starting from points 44*a*, 46*a*, and respectively 45*a*, 47*a*, and joined at top transversal seal area 42 to define an isosceles triangle with the portion of line 40 comprised between points 44*a*, 46*a*, and respectively 45*a*, 47*a*.

Lines 56, 57, and respectively lines 58, 59, define the lateral external limits of lateral flaps 13, 14.

Three further crease lines, indicated with 60, 61, 62 for flap zone 54 and respectively with 63, 64, 65 for flap zone 55, extend along respective bisectors of the isosceles triangle and intersect at the incentre, indicated with 66 for flap zone 54, and respectively with 67 for flap zone 55.

Lines 60, 61 of flap zone 54 extend between incentre 66 and respective points 44*a*, 46*a* and upwardly delimit top portion 20 of side wall 8. Analogously, lines 63, 64 of flap zone 55 extend between incentre 67 and respective points 45*a*, 47*a* and upwardly delimit top portion 20 of side wall 9.

Crease pattern 37 finally includes, in each flap zone 54, 55, a further inclined crease line 70, 71 intersecting relative line 56, 58 and extending between the relative incentre 66, 67 and the relative intersecting point of transversal crease line 38 with longitudinal crease line 50, 51.

In each flap zone 54, 55, line 70, 71, line 56, 58 and the portion of line 38 comprised between lines 56, 70, and respectively lines 58, 71, delimit an end portion 72, 73 of relative lateral flap 13, 14, which is folded onto a relative adjacent portion 74, 75 of material 2 delimited by relative line 50, 51 and the portions of lines 56, 70, and respectively 58, 71, comprised between their intersection point and relative line 50, 51. It will be understood that main portion 3 of package 1 comprised between edges 21, 22 and crease lines 40, 41 can have any design shapes whilst the gabled top portion 4 remains unchanged.

FIGS. 6, 7, 8 and 9 show the basic principle of the present invention applied to gable-top packages 1', 1" presenting relative prismatic main portions 3', 3" having respectively hexagonal and octagonal cross sections. In the following description, package 1', 1" are described only insofar as they differ from package 1, and using the same reference numerals for any parts similar or corresponding to those already described.

Figure 7:
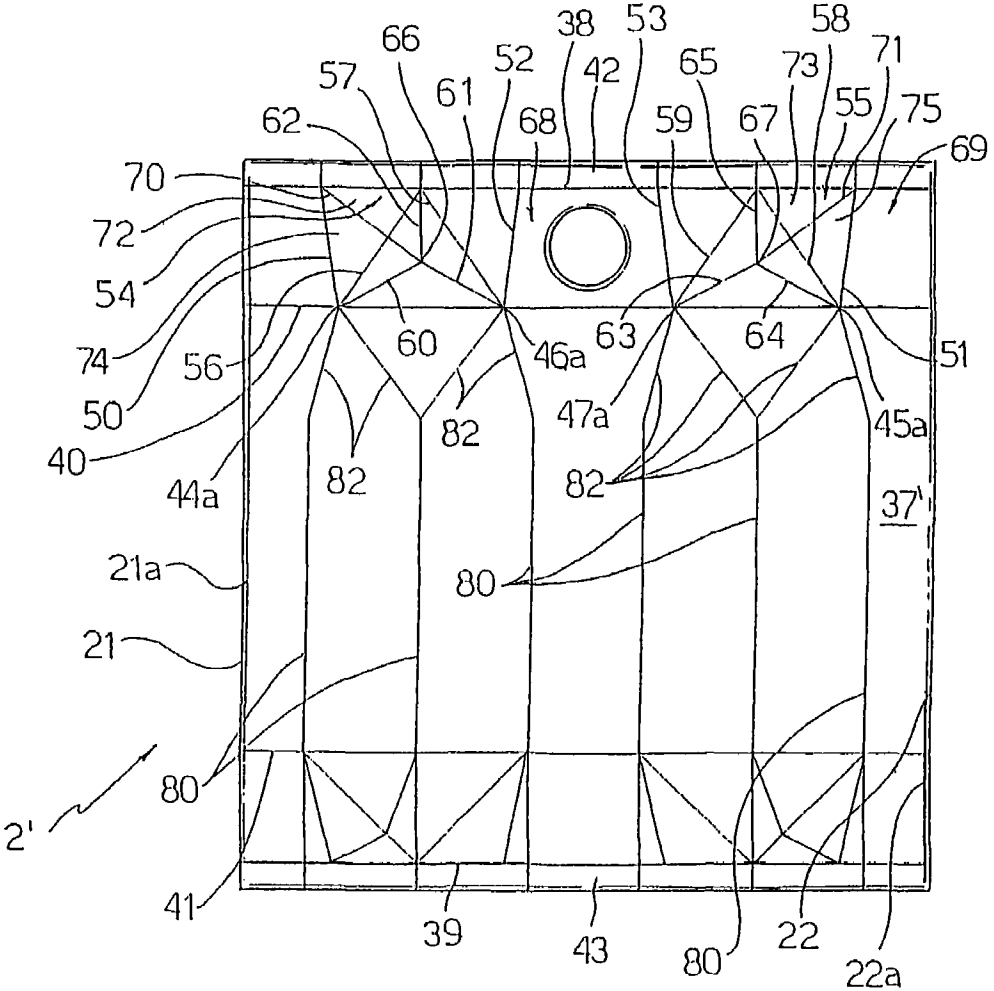
FIG. 7 is a repeatlength portion of a web packaging material for the production of the package of FIG. 6.
Figure 6:
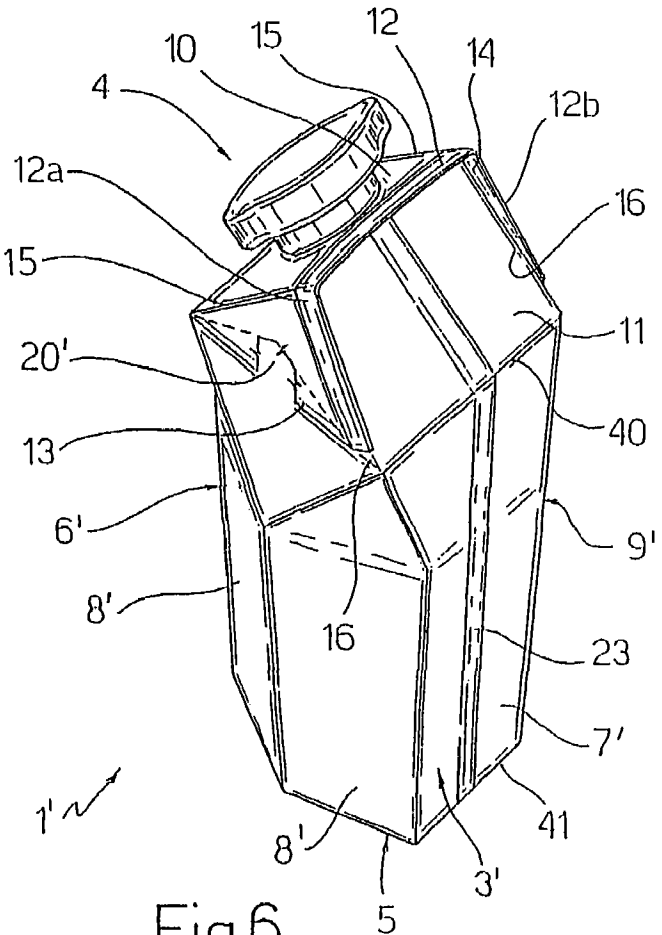
FIG. 6 is a perspective view of another embodiment of a gable-top package in accordance with the present invention.
Figure 9:
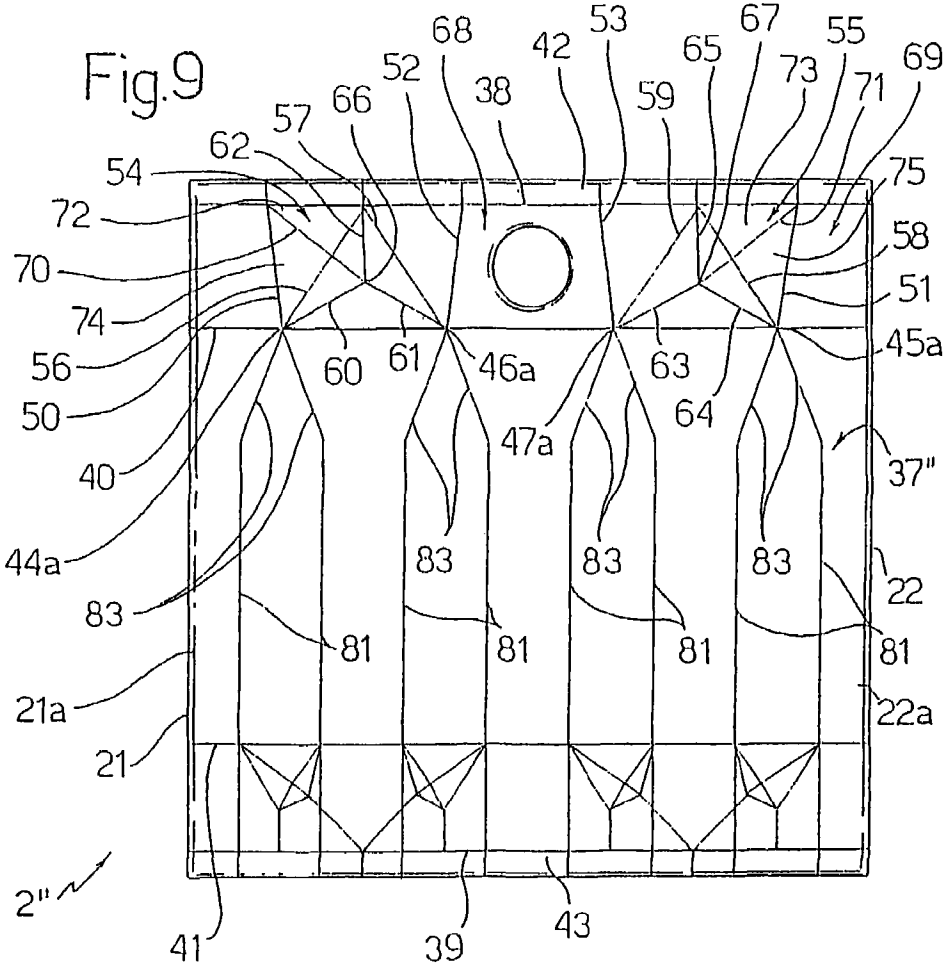
FIG. 9 is a repeatlength portion of a web packaging material for the production of the package of FIG. 8.
Figure 8:
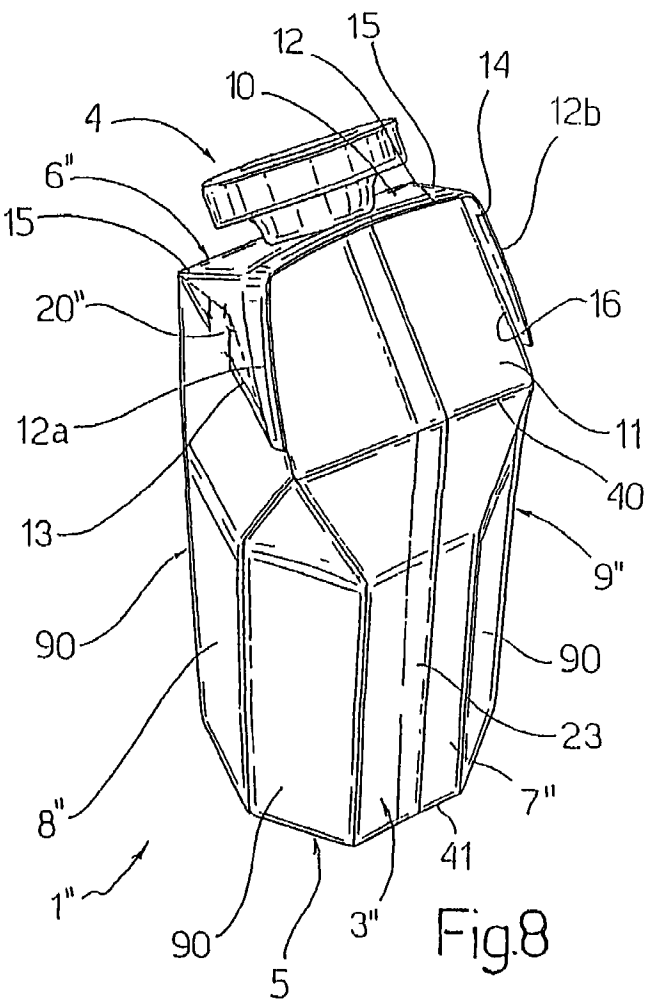
FIG. 8 is a perspective view of a further embodiment of a gable-top package in accordance with the present invention.

Packages 1', 1" are made from respective web packaging materials 2', 2", whose respective repeatlengths are shown in FIGS. 7, 9.

Materials 2', 2" include respective crease patterns 37', 37", each presenting four transversal crease lines identical to transversal crease lines 38, 39, 40, 41 of material 2 and therefore indicated with the same reference numerals.

In the area comprised between transversal crease line 40 and top transversal sealing area 42, the crease lines of each crease pattern 37', 37" have the same arrangement of the corresponding crease lines of crease pattern 37, whilst, in the area comprised between transversal crease line 41 and bottom transversal sealing area 43 have a: known arrangement not-described in detail.

Crease patterns 37', 37" present respectively six and eight longitudinal crease lines 80, 81 forming the side corners of respective packages 1', 1".

Each intersection point 44*a*, 45*a*, 46*a*, 47*a* of each crease pattern 37', 37" is defined by the intersection of transversal crease line 40 with a relative couple of inclined lines, indicated with 82 for crease pattern 37' and respectively with 83 for crease pattern 37", diverging from the intersection point itself and joining together two respective adjacent longitudinal crease lines 80, and respectively 81.

Due to the above described configuration of crease lines, main portion 3' of package 1' is delimited by front and back walls 6', 7' and by opposite couples of inclined side walls 8', 9'. Lateral flaps 13, 14 of package 1' are folded onto respective top portion 20' of opposite side walls 8', 9'.

Package 1" presents a front wall 6", a back wall 7", opposite side walls 8", 9" and four edge walls 90. Lateral flaps 13, 14 of package 1" are folded onto respective top portions 20" of side walls 8", 9".

The advantages of package 1, 1', 1" according to the present invention will be clear from the foregoing description.

In particular, thanks to the fact that gabled top portion 4 is obtained by folding the lateral flaps 13, 14 of a tapered end portion (29) of a pillow pack (26) out of the volume delimited by front and back sloping top walls 10, 11, package 1, 1', 1" can be easily and cheaply produced by web fed filling machines such as the above-mentioned TB and TBA series or the endless chain type, without substantial modifications of such machines. This result can be reached simply by adding some crease lines (60, 61, 62, 70; 63, 64, 65, 71) on the upper transversal portion of a web packaging material normally used for obtaining parallelepiped-shaped, hexagonal-shaped or octagonal-shaped packages.

Clearly, changes may be made to packages 1, 1', 1" as described and illustrated herein without, however, departing from the scope of the accompanying claims.

It is evident that the packages described in the previous embodiments of the present invention may be obtained from a sheet packaging material not only in the form of a web but also in the form of a blark, when the embodiment so permits.

Furthermore, the main portions of the packages described in the various embodiments of the present invention may have different shapes than those disclosed.

The invention claimed is:

1. A gable top package for pourable food products comprising a gabled top portion including a front sloping top wall and a back sloping top wall joined together at a top transversal seal, wherein said gabled top portion includes a pair of lateral flaps adjacent to respective end portions of said top transversal seal and folded out of the package top volume available for the food product and delimited by said front and back sloping top walls, wherein each lateral flap has a first side defined by a lateral edge of the front sloping top wall and a second side formed by a respective end portion of the top transversal seal which is folded onto a lateral edge of the back sloping top wall.

2. A package as claimed in claim 1, being obtained from a pillow pack having at least a tapered end portion delimited by said top transversal seal, defining said front and back sloping top walls and provided with said pair of lateral flaps.

3. A package as claimed in claim 1, comprising a prismatic main portion upwardly delimited by said gabled top portion, said lateral flaps being folded onto respective top portions of opposite side walls of said main portion.

4. A package as claimed in claim 3, wherein said main portion has a rectangular cross section.

5. A package as claimed in claim 3, wherein said main portion has an hexagonal cross section.

6. A package as claimed in claim 3, wherein said main portion has an octagonal cross section.

7. A method for obtaining a gable top package for pourable food products, comprising:

forming a gabled top portion including a front sloping top wall, a back sloping top wall, a top transversal seal joining said front and back sloping top walls, and a pair of lateral flaps protruding from opposite sides of said back and front sloping top walls and delimited at the top by respective end portions of said top transversal seal;

folding said lateral flaps out of the package top volume available for the food product and delimited by said front and back sloping top walls; and folding the respective end portions of the top transversal seal onto lateral edges of the back sloping top wall.

8. A method as claimed in claim 7, comprising the step of forming a pillow pack having opposite tapered end portions transversally sealed at their respective ends, one of said tapered end portions of said pillow pack defining said gabled top portion of said package provided with said lateral flaps.

9. A method as claimed in claim 8, further comprising folding said lateral flaps onto respective top portions of opposite side walls of a prismatic main portion of said package.

10. A sheet packaging material for producing a gable-top package for pourable food products comprising a gabled top portion including a front sloping top wall and a back sloping top wall joined together at a top transversal seal, wherein said gabled top portion includes a pair of lateral flaps adjacent to respective end portions of said top transversal seal and folded out of the package top volume available for the food product and delimited by said front and back sloping top walls, the sheet packaging material including a crease pattern comprising, in an end portion designed to form said gabled top portion of said package, a first transversal crease line delimiting said top transversal seal, a second transversal crease line forming horizontal corners of said gabled top portion, and a plurality of longitudinal crease lines delimiting, together with said first and second transversal crease lines, a couple of first zones defining said lateral flaps and a couple of second zones defining said front and back sloping top walls, each said first zone including a couple of first inclined crease lines joined at said first transversal crease line, delimiting an isosceles triangle with said second transversal crease line and defining respective lateral external limits of a respective one of said lateral flaps, each said first zone further including a second inclined crease line extending from the centre of the isosceles triangle to a relative said longitudinal crease line.

11. A sheet packaging material as claimed in claim 10, wherein, in each said first zone, said second inclined crease line reaches the intersection point between relative said longitudinal crease line and said first transversal crease line.

12. A sheet packaging material as claimed in claim 10, wherein each said first zone includes third inclined crease lines extending along respective bisectors of said isosceles triangle.

13. A sheet packaging material as claimed in claim 10, wherein the sheet packaging material is in the form of a web.

14. A gable-top package for pourable food products comprising a prismatic main portion and a gabled top portion upwardly delimiting said main portion and including a front sloping top wall and a back sloping top wall joined together at a top transversal seal, wherein said gabled top portion includes a pair of lateral flaps adjacent to respective end portions of said top transversal seal and each having a first side adjacent to one of said front and back sloping top walls and a second side formed by an end portion of said top transversal seal, and wherein said lateral flaps are folded onto respective top portions of opposite side walls of said main portion so as to position said second side of each lateral flap adjacent to the other of said front and back sloping top walls.

15. A method for obtaining a gable top package for pourable food products, said method comprising:

forming a prismatic main portion and a gabled top portion including a front sloping top wall, a back sloping top wall, a top transversal seal joining said front and back sloping top walls, and a pair of lateral flaps protruding from opposite sides of said back and front sloping top walls, delimited at the top by respective end portions of said top transversal seal and each having a first side adjacent to one of said front and back sloping top walls and a second side formed by an end portion of said top transversal seal; and folding said lateral flaps onto respective top portions of opposite side walls of said main portion so as to position said second side of each lateral flap adjacent to the other of said front and back sloping top walls.

16. A sheet packaging material for producing a gable top package for pourable food products comprising a prismatic main portion and a gabled top portion upwardly delimiting said main portion and including a front sloping top wall and a back sloping top wall joined together at a top transversal seal, wherein said gabled top portion includes a pair of lateral flaps adjacent to respective end portions of said top transversal seal and each having a first side adjacent to one of said front and back sloping top walls and a second side formed by an end portion of said top transversal seal, and wherein said lateral flaps are folded onto respective top portions of opposite side walls of said main portion so as to position said second side of each lateral flap adjacent to the other of said front and back sloping top walls, the sheet packaging material including a crease pattern comprising, in an end portion designed to form said gabled top portion of said package, a first transversal crease line delimiting said top transversal seal, a second transversal crease line forming horizontal corners of said gabled top portion, and a plurality of longitudinal crease lines delimiting, together with said first and second transversal crease lines, a plurality of first zones defining said lateral flaps and a plurality of second zones defining said front and back sloping top walls, each said first zone including a plurality of first inclined crease lines joined at said first transversal crease line, delimiting an isosceles triangle with said second transversal crease line and defining respective lateral external limits of each said lateral flap, each said first zone further including a second inclined crease line positioned on a line extending from a centre portion of the isosceles triangle to each respective longitudinal crease line.

* * * * *